US009862516B2

(12) United States Patent
Eichhammer

(10) Patent No.: US 9,862,516 B2
(45) Date of Patent: Jan. 9, 2018

(54) GLUE RESERVOIR FOR HOTMELT APPLICATIONS

(71) Applicant: KRONES AG, Neutraubling (DE)

(72) Inventor: Tobias Eichhammer, Bad Abbach (DE)

(73) Assignee: KRONES AG, Neutraubling (DE)

( * ) Notice: Subject to any disclaimer, the term of this patent is extended or adjusted under 35 U.S.C. 154(b) by 384 days.

(21) Appl. No.: 14/185,480

(22) Filed: Feb. 20, 2014

(65) Prior Publication Data

US 2014/0311404 A1 Oct. 23, 2014

(30) Foreign Application Priority Data

Apr. 17, 2013 (DE) ..... 10 2013 206 886

(51) Int. Cl.
*B65C 9/22* (2006.01)
*B05C 11/10* (2006.01)

(52) U.S. Cl.
CPC ..... *B65C 9/2256* (2013.01); *B65C 9/22* (2013.01); *B05C 11/1042* (2013.01)

(58) Field of Classification Search
USPC ..... 156/578
See application file for complete search history.

(56) References Cited

U.S. PATENT DOCUMENTS 2,773,617 A * 12/1956 Weiss ..... B65C 9/08 156/357
3,585,361 A * 6/1971 Rosen ..... B29B 13/022 126/343.5 A
3,728,985 A * 4/1973 Dunlap ..... A43D 25/053 118/410
4,347,095 A * 8/1982 Yamashita ..... B65C 9/2269 118/221
4,395,968 A * 8/1983 Wahnschaff ..... B05C 1/0813 118/202
4,413,255 A * 11/1983 Cohen ..... G01F 23/247 137/558

(Continued)

FOREIGN PATENT DOCUMENTS

DE 38745 A 8/1965
DE 1940934 C3 3/1971

(Continued)

OTHER PUBLICATIONS

Office Action, Chinese Patent Application No. 201410119137.9, dated Jul. 29, 2015.

(Continued)

*Primary Examiner* — Sing P Chan
(74) *Attorney, Agent, or Firm* — Marshall, Gerstein & Borun LLP

(57) ABSTRACT

An apparatus for the application of hotmelt onto labels, includes a vacuum cylinder, a gluing unit with a glue roller unit, and a glue reservoir. The gluing unit is pivotally mounted such that it can be slewed away from the vacuum cylinder and the glue reservoir is designed as a self-contained unit that is structurally separate from the pivotable gluing unit. A glue reservoir for hotmelt includes an inner body with heating fins, a thermally insulating jacket enclosing the inner body, and an outer casing made of plastic.

16 Claims, 2 Drawing Sheets

(56) References Cited

U.S. PATENT DOCUMENTS

| | | | | | |
|---|---|---|---|---|---|
| 4,456,151 | A * | 6/1984 | Lewellen | B29B 13/022 | 222/146.5 |
| 5,435,882 | A * | 7/1995 | Azamar | B32B 37/22 | 156/233 |
| 5,849,358 | A * | 12/1998 | Le Riche | B05C 1/0808 | 118/227 |
| 6,033,513 | A * | 3/2000 | Nakamura | B05C 1/0813 | 118/211 |
| 2002/0106455 | A1* | 8/2002 | Keite-Telgenbuscher | B05C 1/083 | 427/355 |
| 2009/0095372 | A1* | 4/2009 | Deckert | B65C 9/2247 | 141/270 |
| 2010/0272582 | A1* | 10/2010 | Grenon | A47J 31/46 | 417/53 |
| 2012/0138212 | A1* | 6/2012 | Toriumi | B29C 47/0019 | 156/109 |
| 2013/0112711 | A1* | 5/2013 | Lind | B65D 83/00 | 222/146.5 |
| 2013/0249144 | A1* | 9/2013 | Carlson | B29C 45/68 | 264/328.8 |

FOREIGN PATENT DOCUMENTS

| | | | |
|---|---|---|---|
| DE | 8432012 | U1 | 2/1985 |
| DE | 69411923 | T2 | 3/1999 |
| DE | 10226281 | A1 | 12/2003 |
| DE | 102006034940 | A1 | 3/2007 |
| DE | 102009033030 | A1 | 1/2011 |
| EP | 2476624 | A1 | 7/2012 |
| EP | 2505507 | A1 | 10/2012 |
| GB | 579175 | A | 7/1946 |
| WO | WO-2008107058 | A1 | 9/2008 |
| WO | WO-2012090233 | A1 | 7/2012 |

OTHER PUBLICATIONS

German Search Report for DE 10 2013 206 886.7, dated Dec. 13, 2013.

European Search Report, corresponding European Patent No. 14150880, dated May 16, 2015.

* cited by examiner

GLUE RESERVOIR FOR HOTMELT APPLICATIONS

CROSS-REFERENCE TO RELATED APPLICATION

The present application claims priority to Germany Application No. 10 2013 206 886.7, filed Apr. 17, 2013. The priority application, DE 10 2013 206 886.7, is incorporated herein by reference

FIELD OF THE DISCLOSURE

The present disclosure relates to an apparatus for applying hotmelt onto labels, in particular onto wrap-around labels, with a gluing unit with a glue roller unit as well as a glue reservoir for hotmelt.

PRIOR ART

Modern labeling machines are used in the industry to apply labels continuously and at a high performance to continuously supplied products or containers. The containers can be cans, glass bottles, PET bottles or the like.

In this, a labeling machine generally comprises at least one container supply, a container bench, a container discharge and at least one labeling assembly, where the labeling assembly comprises at least one label reel, a label supply, a cutting device, a gripper cylinder and at least one guiding unit. A gluing unit is used In order to be able to provide a label element with a stripe of glue.

In labeling machines that apply labels with hotmelt onto the containers (e.g., Contiroll, Canmatic) the gluing unit in prior art comprises a glue tank, a glue heating device, a glue pump and a glue roller. The hotmelt given into the glue tank and liquefied by the glue heating device is thereby ready for processing and is via the glue pump pumped out of the glue tank and supplied onto the glue roller at its outer surface. A glue scraper with a scraping strip is advanced to the glue roller so closely that the scraping strip removes excess glue during rotation of the glue roller and only a thin film of glue remains on the outer surface of the glue roller. The remainder of glue on the scraping strip is again returned to the glue tank, thereby forming a circulation of glue.

In current prior art, the glue tank and glue roller are coupled. In general, the components of the gluing unit are mounted on a common gluing unit base plate and thereby form a joint structural unit. The gluing unit, however, must be slewed away from the label at regular intervals due process-related aspects, in particular because the glue roller for hotmelt applications must be cleaned regularly. Above all, so-called glue baking and contamination of the glue roller play a major role in this. During cleaning cycles, the glue roller is generally manually cleaned by the operator.

Due to the fixed attachment of the glue tank to the gluing unit, however, large masses are to be moved when the gluing unit is slewed away from the label. Moreover, the arrangement of the glue tank inhibits accessibility to the labeling assembly.

Furthermore, the glue tank is in prior art designed as a sheet metal or welded structure, where the outer housing of the glue tank becomes so hot due to the high temperature of the hotmelt that this could pose a hazard to an operator. In addition, the glue tank suffers high energy loss due to the radiation of heat via the outer casing.

Finally, the hotmelt is in prior art supplied to the glue roller by a gear pump, whereby the quality of the hotmelt is reduced due to inevitable squeezing of the hotmelt between the gears and the resulting tearing of the polymer chains of the hotmelt.

The present disclosure is therefore based on the objective to overcome the above-mentioned drawbacks of prior art, and in particular to facilitate cleaning of the gluing unit and to improve safety for the operating personnel. More generally, there is also the objective to simplify the design of the labeling machine and to increase energy efficiency of the machine.

SUMMARY OF THE DISCLOSURE

The above objective is satisfied by an apparatus for applying hotmelt onto labels comprising a vacuum cylinder, a gluing unit with a glue roller unit, and a glue reservoir, wherein the gluing unit is pivotally mounted such that it can be slewed away from the vacuum cylinder, and wherein the glue reservoir is designed as a self-contained unit that is structurally separate from the pivotable gluing unit.

The vacuum cylinder and the glue roller unit are sufficiently known from prior art. The vacuum cylinder presently serves as a gripper cylinder to which the labels are transferred individually, and which by rotation passes the individual labels with the back side facing outwardly past the glue roller unit so that the labels are applied glue in a particular label region depending on their type. The vacuum cylinder and the glue roller unit of the gluing unit are arranged such that the individual labels when passed along the glue roller unit contact the glue roller at a particular region so that they are provided with glue in predetermined regions. These glue stripes are then needed for gluing the labels onto the products to be labeled. For this purpose, the glue roller unit can comprise elevations at predetermined locations. Passing the individual labels along the glue roller unit is done by having the glue roller unit and the vacuum cylinder rotate in opposite directions. The vacuum cylinder and the glue roller unit can each be driven by a controllable motor.

According to the present disclosure, the gluing unit is pivotally mounted with the glue roller unit such that it can be slewed away from the vacuum cylinder. The gluing unit can in particular be pivoted about an axis that is parallel to the axis of rotation of the vacuum cylinder. Slewing away and/or returning the gluing unit to the vacuum cylinder can be performed manually by an operator or mechanically by a motor attached to the pivot axis. The gluing unit with the glue roller unit can presently be configured as a self-contained unit that is additionally detachably connected to the pivot mount of the labeling assembly. In addition to the glue roller unit, the gluing unit can further comprise a glue heating device and/or a glue strip, where the glue heating device causes the hotmelt to remain liquid during processing by the glue roller unit. The glue strip can be moved so near to the glue roller unit that it removes excess glue during rotation of the glue roller. Excess glue can then via a return line be returned to the glue reservoir or to a separate collection container. By slewing away the pivotally mounted gluing unit from the vacuum cylinder, in particular access to the gluing unit can be provided for its cleaning.

Unlike prior art, however, the glue reservoir of the apparatus described above is not rigidly coupled to the gluing unit having the glue roller unit, but designed as a self-contained unit structurally separate from the gluing unit. The glue reservoir and the gluing unit are in particular not mounted on a common gluing unit base plate, but embodied separate from each other. This means that the glue reservoir, when slewing away the gluing unit from the vacuum cylinder, is not moved along with the latter, but instead remains stationary. The glue reservoir can in particular stand on a floor space, e.g. the floor next to a labeling assembly comprising the above-described apparatus, or be connected to a stationary part of the labeling assembly, such as a frame construction.

The glue reservoir can presently be embodied as in prior art or according to one of the further developments described below. The glue reservoir is during start-up of the labeling assembly filled with a melt adhesive or hot glue, also referred to as hotmelt, which can be processed at temperatures between 70° and 190° C., preferably between 110° and 190° C. The processed hotmelt can be polymer-based hotmelt, in particular, hotmelt comprising polyurethane based on a polymer. Examples of base polymers for hotmelts are: Polyamide (PA) with application temperatures usually above 200° C., polyethylene (PE) with application temperatures of 140° to 200° C., amorphous polyalphaolefins (APAO) with application temperatures around 170° C., ethylene vinyl acetate copolymers (EVAC) with application temperatures of 150° C., thermoplastic polyester elastomer (TPEE), thermoplastic polyurethane elastomers (TPE-U), copolyamide elastomer (TPE-A) and vinylpyrrolidone/vinyl acetate copolymers with application temperatures of about 130° C.

By decoupling the glue reservoir from the gluing unit, accessibility to the labeling assembly can be improved. When slewing the gluing unit (slewing away and towards), less mass needs to be moved, so that higher moving speeds can be achieved.

In a further development, the glue reservoir can be connected to the gluing unit via a supply line that is deformable by slewing away the gluing unit. The supply line can in particular be formed as a U-shaped tube that is stretched when the gluing unit is slewed away. In this, the supply line can be made of elastically deformable material, such as heat-resistant rubber or silicone, but also of elastically deformable metal. The supply line can in particular comprise a compression-proof and chemical-resistant inner tube, for example, made of polytetrafluoroethylene (PTFE), which is surrounded by at least one insulating layer of elastically deformable material suitable for the desired operating temperature, for example, silicone foam. A heat conductor can with an optional temperature sensor be wrapped between the inner tube and the insulating layer (see below) on the inner tube or on a protective mesh surrounding the inner tube. Finally, the at least one isolating layer can be protected towards the exterior by a further protective mesh. The inner tube can be manufactured with a variety of nominal widths and materials depending on the required throughput of hotmelt and/or the desired operating pressure. Due to the supply line being formed highly flexible, the gluing unit can be moved without much effort.

Deformable presently and hereinafter means elastically deformable within the meaning that the shape and cross-section of the supply line are not changed when repeatedly moving the gluing unit to and fro, that the function of the supply line, in particular its connection points to the glue reservoir and/or the gluing unit, are unimpaired. Due to the elastically deformable supply line with which the glue reservoir is connected to the gluing unit, the gluing unit with the glue roller unit can be moved in an easy manner away from the vacuum cylinder and towards the vacuum cylinder. In addition to the elastically deformable supply line, the glue reservoir can also be connected via an elastically deformable return line to the gluing unit, via which excess hotmelt can be returned from the glue roller unit to the glue reservoir.

In another further development, the supply line further comprises a first heating device. The first heating device can be used to heat the glue passed in the supply line or to maintain constant the temperature of the glue passed in the supply line. The first heating device can presently at least sectionally comprise a heating line, in particular a heating tube and/or a heating pipe, and/or a non-contact heating device. The non-contact heating device can be an induction heating device. With a heating line designed as a heating tube or a heating pipe, the quantity of glue passed through the supply line can be tempered at a transport state or at a static or stationary state, respectively, i.e. be heated or kept at a constant temperature level. The heating line can in particular be wrapped onto an inner tube of the supply line. Furthermore, the inner tube enwrapped by the heating line can be covered with at least one insulating layer. The insulating layer reduces heat transfer from the heating line to the outer ambience and increases safety for the operating personnel. Wrapping the heating line onto the inner tube results in an elastically deformable supply line. Furthermore, the supply line can comprise at least one sensor device for determining parameters, in particular a temperature of the glue passed through the supply line and/or a temperature of the supply line. The heating line wrapped onto the inner tube can in particular comprise a temperature sensor. In addition to a sensor device for determining the temperature, the supply line can comprise further sensors for determining the flow rate, glue composition and/or viscosity of the glue in the supply line. Depending on the specific parameters, in particular of the temperature of the glue in the supply line, heat output of the first heating device can be controlled and/or regulated by an open-loop and/or closed-loop control device adapted for this. To improve the flow properties of the glue in the supply device, an inner surface of the supply line can be formed as being smooth.

According to another development, the apparatus comprises a vane pump, wherein the vane pump is designed to deliver hotmelt from the glue reservoir to the glue roller unit. The vane pump or rotary vane pump can be connected to the supply line such that the hotmelt extracted by the vane pump from the glue reservoir is supplied via the feed line to the gluing unit with the glue roller unit.

By using a vane pump or a rotary vane pump for delivering the glue instead of the gear pumps known in prior art, reduction in glue quality, due to squeezing of the glue between the gear wheels of the gear pump thereby tearing the polymer chains of the hotmelt, can be prevented. This improves flow properties, viscosity and adhesive properties of the hotmelt used. The vane pump therefore ensures gentle glue treatment and better glue quality.

In another development, the vane pump can be driven by a controllable motor. The controllable motor presently drives the rotor of the vane pump, where an open-loop and/or closed-loop control device controls and/or regulates the rotational speed of the rotor. The output of the vane pump can be controlled in dependency of process parameters such as the throughput of products to be labeled, the amount of hotmelt needed for one label, the type of hotmelt used, and/or similar parameters.

In another further development, the vane pump can comprise a second heating device. The second heating device can presently be mounted in particular in the receiving area of the vane pump. The second heating device can be a heating line, a heating coil, a non-contact heating device or some other heating device known in prior art. It is prevented by the second heating device that the glue hardens in the region of the vane pump, in particular in its receiving area. Moreover, a cylinder (rotor) of the vane pump can also be a heatable.

Further objectives mentioned above are also satisfied by a glue reservoir for hotmelt, comprising:

an inner body with heating fins a thermally insulating jacket which encloses the inner body, and an outer casing made of plastic.

The inner body accommodates the hot melt to be processed, where the inner surface of the inner body is provided with heating fins to improve heat transfer. The inner body can preferably be made of cast aluminum. The thermally insulating jacket encloses the inner body at least partially and can comprise in particular polyisocyanurate (PIR) and/or polyurethane (PU) for thermal insulation. The thermally insulating jacket acts as an insulating layer between the hot inner body in which the hotmelt is located and the outer casing made of plastic. The outer casing made of plastic in addition to the manipulatability of the glue reservoir also serves to protect the operating personnel and can therefore also be made of thermally insulating plastic. By thermally insulating the thermally insulated jacket and/or of the outer casing made of plastic, endangering operating personnel during handling actions is prevented, in particular when filling and/or cleaning the glue reservoir, and energy losses due to dissipation of heat via the outer casing is additionally reduced. In addition, the outer casing of the glue reservoir can in a simple manner be cast from plastic which results in reduction of assembly time.

According to a further development, the inner body can have a non-stick coating coated at least partially onto its inner side. Due to the non-stick coating, hotmelt can be easily removed from the tank when changing glue. This is particularly advantageous in the region of the heating fins, because otherwise excess glue would when changing glue remain between the heating fins.

According to a further development, the glue reservoir can further comprise a third heating device, in particular a heating cartridge. However, the third heating device can also comprise several heating cartridges, in particular one heating cartridge for every heating fin of the inner body. The third heating device can be accommodated in the lower portion of the inner body, so that the hotmelt contained in the inner body can be heated and liquefied from below. The heating fins ensure most efficient heat transfer from the third heating device to the hotmelt. Alternatively or additionally, the third heating device can also be attached in the region of one or more side walls of the glue reservoir. The third heating device can be attached in the inner body itself and/or in the interior of the inner body. The at least one heating cartridge can further comprise a built-in thermocouple to measure the local temperature.

According to a further development, the glue reservoir can further comprise at least one temperature sensor. As described above, the at least one temperature sensor can be configured as a thermocouple of a heating cartridge. However, the at least one temperature sensor can also be attached in the upper region of the glue reservoir, in particular in the region of a lid. Additionally and/or alternatively, at least one temperature sensor can be attached to the inner region of the inner body in order to be able to directly determine the temperature of the hotmelt in the glue reservoir. Furthermore, a temperature sensor can be attached in the receiving area of the vane pump (see farther below) to ensure that hotmelt is collected by the vane pump at a desired temperature, in particular with a desired viscosity and conveyed to the gluing unit with the glue roller unit.

As already mentioned, the glue reservoir can further comprise a vane pump, wherein said vane pump is designed to extract hotmelt from the glue container. The vane pump or rotary vane pump can correspond to the vane pump described above. The vane pump can in particular be adapted to deliver hotmelt from the glue reservoir via a supply line to a gluing unit with a glue roller unit via which the hotmelt is applied to labels.

As described above, by using a vane pump or a rotary vane pump for delivering the glue instead of the gear pumps known in prior art, reduction in glue quality, due to squeezing of the glue between the gear wheels of the gear pump thereby tearing the polymer chains of the hotmelt, can be prevented. This improves flow properties, viscosity and adhesive properties of the hotmelt used. The vane pump therefore ensures gentle glue treatment and better glue quality.

According to another development, the vane pump can be driven by a controllable motor. The controllable motor can be connected via a thermo-flange with a coupling element to the vane pump. The pump output or the pump volume, respectively, of the vane pump can be controlled and/or regulated, in particular in a continuously variable manner, by the controllable motor using an integrated open-loop and/or closed-loop control unit. In this, controlling and/or regulating can be performed by the operator in dependency of predetermined parameters, such as a feed rate of products to be labeled, the quantity of glue required for a label, the type of hotmelt, or other parameters of the process control, and/or continuously or periodically measured process parameters, such as the temperature of the hotmelt in the interior of the inner body, the viscosity of the hotmelt, and/or a flow rate of the hotmelt in a supply line.

According to another further development, the vane pump can comprise a fourth heating device. The fourth heating device can in particular be identical to the second heating device described farther above. The fourth heating device can in particular be attached in the receiving area of the vane pump and be designed in the form of a heating line, a heating coil or a non-contact heating device. In particular solidification of the hotmelt due to cooling in the receiving area of the vane pump and/or in the interior of the vane pump can be prevented with the fourth heating device.

According to a further development, the glue reservoir can furthermore comprise an open-loop and/or closed-loop control unit, wherein the open-loop and/or closed-loop control unit is adapted to control and/or regulate heat output of the third and/or fourth heating device according to a signal of the temperature sensor. If the at least one temperature sensor of the glue reservoir reports a drop in the temperature of the glue in the respective region beneath a target temperature depending on the type of glue, which can be specified by the user via input device, then the open-loop and/or closed-loop control unit automatically increases the heat output of the respective heating device to raise the temperature of the glue to the desired level. By attaching respective temperature sensors in the interior of the inner body, in the receiving area of the vane pump, and/or in the supply line, it can thereby be ensured that sufficient heat output is always available to keep the hotmelt in a melted state in the desired region of the device, in particular at a desired, predetermined viscosity. Complex cleaning due to solidified hotmelt in the region of the glue reservoir and/or the gluing unit can thereby be avoided. The at least one temperature sensor delivers signals continuously or at regular intervals to the open-loop and/or closed-loop control unit as part of the controlling and/or regulating action.

According to a further development, the glue reservoir can further comprise a display device, wherein the display device is adapted to display a temperature of a hotmelt contained in the glue reservoir and/or a filling level of the glue reservoir. The display device can be a display, in particular having touch functionalities, in particular a liquid crystal display. The display device can presently be mounted directly at the glue reservoir and be integrally formed with it, or formed as a separate display device, in particular as part of a process control and/or regulating unit. By continuously displaying the temperature of the hotmelt contained in the glue reservoir and/or the filling level of the glue reservoir, an operator of the apparatus can in a simple manner monitor the labeling process with respect to the provision of hotmelt. In addition, the operator can set a desired target temperature via a touch functionality of the display device, which can be used by the open-loop and/or closed-loop control unit described above for controlling and/or regulating the third and/or fourth heating device.

According to the present disclosure, each of the embodiments and further developments of the glue reservoir described above can be combined with the apparatus described farther above for the application of hotmelt onto labels. In this, the vane pump described in connection with the glue reservoir can in particular correspond to the vane pump belonging to the apparatus for applying hotmelt.

Further features and embodiments as well as advantages of the present disclosure are by way of example illustrated below using the drawings. It is understood that the embodiments do not exhaust the scope of the present disclosure. It is further understood that some or all features described hereafter can also be combined in other ways.

In a labeling machine, labels are applied with high throughput onto products that are in general continuously supplied in a single-lane row. The products or containers can presently be cans, glass bottles, PET bottles or the like.

For this, a labeling machine is in general provided with a feed conveyor that supplies the products to the labeling machine, and with at least one in-feed star wheel with a commonly upstream feed screw supplying the products individually via a guide curve to a carousel on which the products revolve. Located on the carousel is generally a plurality of evenly spaced rotary disks receiving the products. At the outlet of the carousel, a delivery star wheel again receives the products and leads them to a discharge conveyor that conveys the products out of the labeling machine and to subsequent processing steps. The transport elements moving the products through the labeling machine are generally continuously drivable in sync with each other in terms of speed and position.

A labeling assembly for applying labels onto the products is located in the circulation area between the in-feed star wheel and the delivery star wheel at the outer periphery of the carousel.

Figure 1:
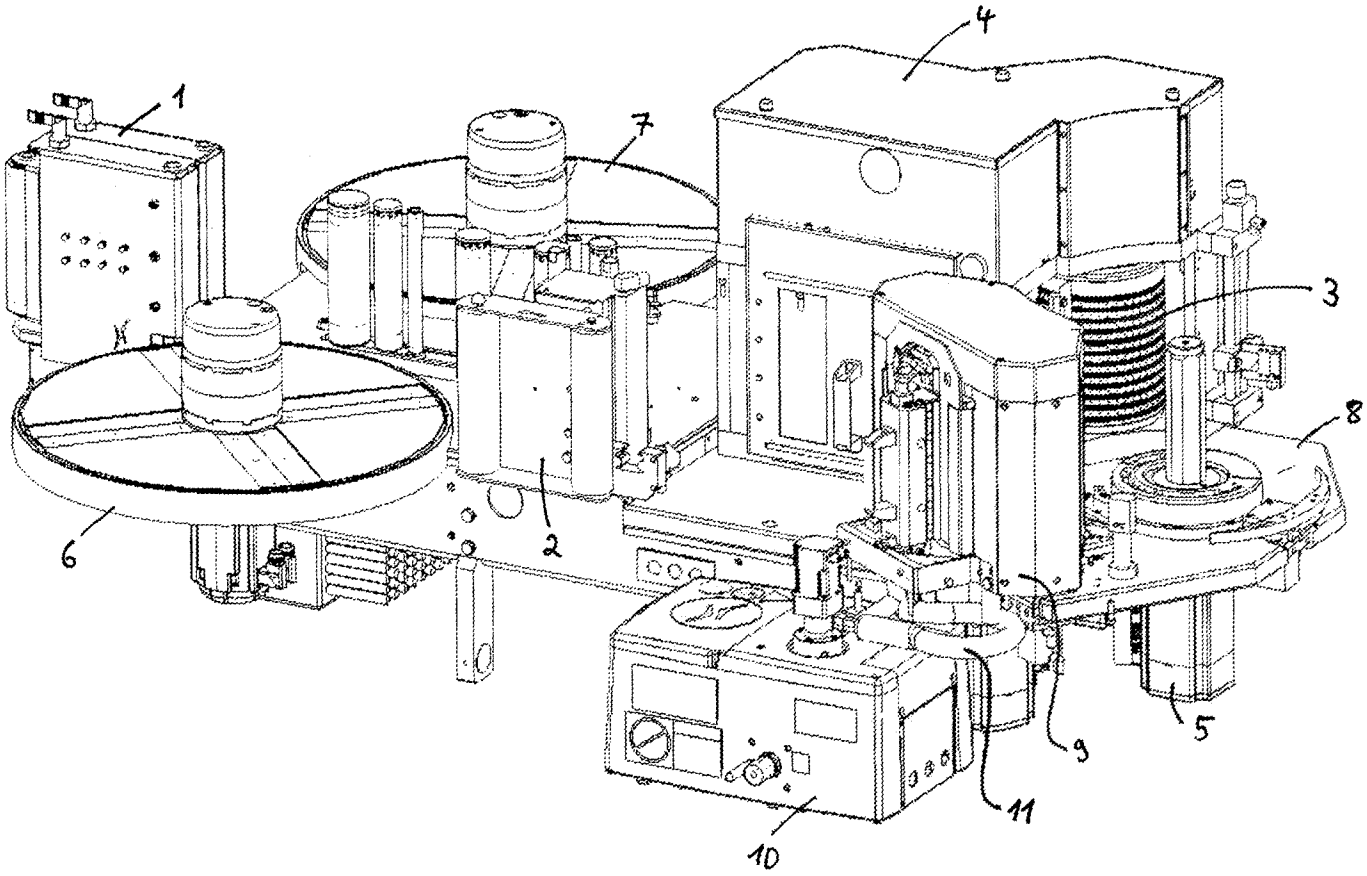
FIG. 1 represents a schematic diagram of an example of a labeling assembly, wherein the gluing unit with the glue roller unit and the glue reservoir are arranged according to the present invention.

A schematic diagram is shown in FIG. 1 as an example of such a labeling assembly, where the arrangement of the gluing unit with the glue roller unit and the glue reservoir is embodied according to the present invention. The illustrated exemplary labeling assembly comprises an automatic gluing unit 1, a conveyor disk for a first and a second label strip 6 and 7, as well as a track control unit 2 for controlling the track of the labels supplied. A label strip is drawn off the label strips in a controlled manner and passed along a sensor—presently not shown—which recognizes print marks or a print image, respectively, and is cut according to the print image or trim marks, respectively, in the cutting device 4 associated with the sensor. The severed label, which is during the cutting operation with the print image facing outwardly disposed on the rotating vacuum roller 3, is after the severing process transferred to a vacuum cylinder being driven by the servo motor 5. In the exemplary embodiment presently shown, the servomotor 5 reaches through the base plate 8 of the labeling assembly to drive the vacuum cylinder (not shown).

The label transferred to the vacuum cylinder is with back side facing outwardly by rotation of the vacuum cylinder passed along the glue roller integrated in the gluing unit 9 and is applied glue in a certain area of the label, depending on its type. The label having the glue applied is then supplied tangentially to the carousel on which the products are located. The label with its applied glue is contacted with the product and is with a suitable motion of the product rolled off onto the latter. After having passed the labeling assembly and after having completed application of the label onto the product, the labeled product in the further course after the carousel reaches the delivery star wheel and is there transferred to the discharge conveyor.

According to the present disclosure, the gluing unit is pivotally mounted with the glue roller unit such that it can be slewed away from the vacuum cylinder being driven by the servo motor 5—not shown. The labeling assembly shown in FIG. 1 further comprises a glue reservoir 10 for hotmelt, which is connected to the gluing unit 9 via an elastically deformable tube 11. According to the present disclosure, however, the glue reservoir is designed as a self-contained unit that is structurally separate from the gluing unit 9. In the exemplary illustration of FIG. 1, the glue reservoir 10 is, apart from the supply line 11, not connected to the gluing unit 9 but separately attached to the base plate or the base support 8, respectively, of the labeling assembly. Alternatively, the glue reservoir 10 can also be placed directly on the floor beside the labeling apparatus. By separately designing the glue reservoir 10 as an independent unit which is structurally separate from the gluing unit 9, the gluing unit 9 can be slewed away from the vacuum cylinder or towards the vacuum cylinder without taking along the relatively heavy glue reservoir, as is usual the case in prior art. Slewing away the gluing unit 9 is additionally facilitated by using an elastically deformable hose as a supply line 11. As described above, the glue reservoir 10, the supply line 11, and the gluing unit 9 can each comprise separate heating devices making the hotmelt flowable or bringing it to or maintaining it at the processing temperature, respectively.

Figure 2:
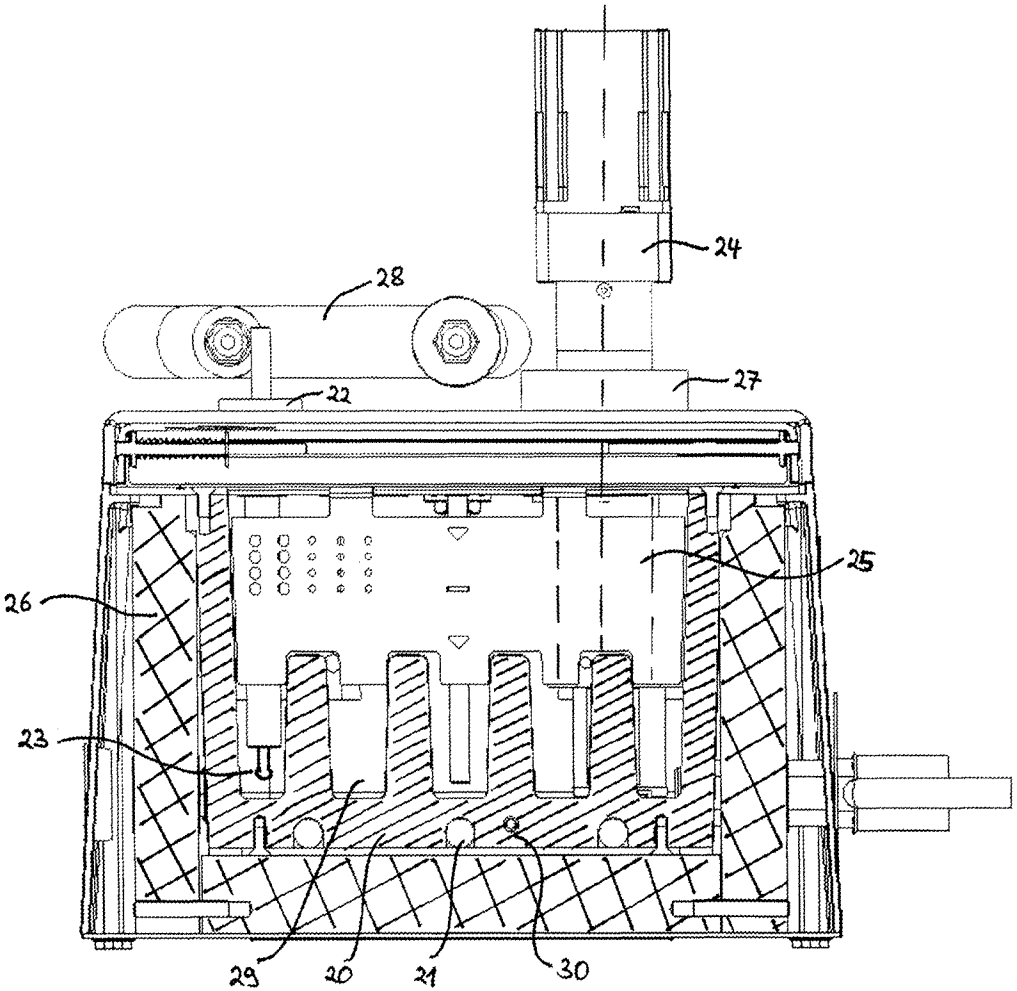
FIG. 2 represents a schematic diagram of an example of a glue reservoir for hotmelt according to the present invention.

FIG. 2 represents a schematic diagram of an example of a glue reservoir for hotmelt according to the present invention. The glue reservoir comprises an inner body 20 which is preferably made of cast aluminum, a thermally insulating jacket 26 which encloses the inner body and preferably comprises polyisocyanurate (PIR) and/or polyurethane (PU), and an outer casing made of plastic. The outer casing made of a plastic injection-molded member encloses the thermally insulating jacket 26. The inner body 20 presently shown by way of example comprises a plurality of heating fins which are illustrated as structures emerging from the base. Heat transfer from the heating cartridges 21 located in the base of the inner body 20 to the hotmelt 29 located in the interior of the inner body 20 is improved by the heating fins. In the embodiment presently illustrated by way of example, the inner body comprises three heating cartridges 21.

To facilitate a change of glue, the inner surface of the inner body 20 is at least partially coated with a non-stick coating. In particular the gaps between the heating fins can be coated with such a non-stick coating. For determining the temperature of the inner body, at least one temperature sensor 30 is disposed in the base of the inner body and delivers the measured temperature to an electronic unit for controlling and/or regulating the heat output of the heating cartridges 21. The temperature sensor can in particular be integrated as a thermocouple in the cartridges 21. The electronic unit for controlling and/or regulating the heat output of the heating cartridges 21 can be integrated into the glue reservoir or be formed separately.

In addition to the temperature sensor 30 of the inner body 20, the glue reservoir presently illustrated by way of example further comprises a temperature sensor 23 which directly measures the temperature of the hotmelt 29. The glue reservoir illustrated additionally comprises a glue temperature sensor 22 in the lid of the reservoir.

For removing hotmelt from the glue reservoir, the glue reservoir is equipped with a vane pump 25 which is coupled to a controllable motor 24 via a thermo-flange 27. The receiving area of the vane pump or the vane pump 25, respectively, can presently comprise a heating device, presently not shown, that [sic] the hotmelt collected by the vane pump in dependency of temperature data delivered by the temperature sensors 22, 23, 30 and/or a temperature sensor in the mounting region of the vane pump 25 to an open-loop and/or closed-loop control unit—not shown—for the in particular steplessly controllable motor 24 of the vane pump.

The vane pump 25 supplies hotmelt via a heatable flow or supply line 28 from the glue reservoir to the gluing unit shown in FIG. 1 at a flow rate controlled by the controllable motor 24. As described above, the flow rate of the hotmelt supplied by the vane pump 25 depends, for example, on the type of hotmelt used, the quantity of glue required for a label, and/or the throughput of the labeling machine. The heating device—not shown—for heating the flow line 28 can be embodied as described above, in particular, as a heating line or as a heating pipe, respectively. The flow line 28 is additionally made of elastically deformable material so that minor or no forces act upon the glue reservoir when moving the gluing unit towards and away from the vacuum cylinder. The heat output of the heating device of the flow line 28 can also be controlled in dependency of measured temperatures, in particular, by one or more temperature sensors in the region of flow line.

For improved extraction of hotmelt from the glue reservoir by the vane pump 25, the base of the inner body 20 can be inclined downwardly towards the vane pump 25 at a predetermined angle. Furthermore, the glue reservoir can be connected to a touch panel indicating inter alia the temperature of the hotmelt contained in the inner body and a filling level of the hotmelt. An operator can via the touch display also specify required processing parameters such as the type of hotmelt used, the desired processing temperature, or the capacity of the vane pump 25. In addition, simple monitoring of the above parameters by the operator is possible using the touch screen. However, the display can also be designed without said touch functionalities. Furthermore, the display can be formed either integrated in the container or separate or integrated in a separate open-loop or closed-loop control unit, respectively.

The glue reservoir illustrated in FIG. 2 and described above can be used for all hotmelt applications. Use of the hotmelt reservoir is in particular possible with Contiroll and Canmatic labeling machines and in combination with spray gluing.

The invention claimed is:

1. An apparatus for applying hotmelt onto labels, comprising:
- a vacuum cylinder,
- a gluing unit comprising a glue roller unit, and
- a glue reservoir,
- the gluing unit pivotally mounted such that it can be manually pivoted away from said vacuum cylinder into a cleaning position to provide access to the gluing unit for cleaning, and
- the glue reservoir being a self-contained unit that is structurally separate from said pivotable gluing unit and not mounted on a common base plate with the gluing unit, wherein
  - the glue reservoir remains stationary when pivoting away the gluing unit into the cleaning position,
  - the glue reservoir being connected to said gluing unit via a supply line,
  - the supply line having an elasticity permitting the supply line to elastically deform throughout a range of motion of the gluing unit when pivoting away the gluing unit into the cleaning position, and
  - the supply line includes a U-shaped tube that is stretched by pivoting away the gluing unit into the cleaning position.

2. The apparatus according to claim 1, further comprising a vane pump, the vane pump is adapted to deliver hotmelt from said glue reservoir to the glue roller unit.

3. The apparatus according to claim 2, the vane pump comprising a first heating device.

4. The apparatus according to claim 1, the glue reservoir comprising:
- an inner body with a plurality of heating fins,
- a thermally insulating jacket which encloses the inner body, and
- an outer casing made of plastic.

5. The apparatus according to claim 4, the inner body being at least partially coated with a non-stick coating on its inner side.

6. The apparatus according to claim 4, the glue reservoir further comprising a second heating device.

7. The apparatus according to claim 6, the glue reservoir further comprising at least one temperature sensor.

8. The apparatus according to claim 7, further comprising a vane pump, that extracts hotmelt from the glue reservoir.

9. The apparatus according to claim 8, the vane pump including a third heating device.

10. The apparatus according to claim 9, further comprising at least one of an open-loop or closed-loop control unit, that at least one of controls or regulates a heat output of at least one of the second or the third heating device according to a signal of the temperature sensor.

11. The apparatus of claim 4, the glue reservoir further comprising a display device that displays at least one of a temperature of a hotmelt contained in the glue reservoir or a filling level of the glue reservoir.

12. The apparatus of claim 6, the second heating device being a heating cartridge.

13. The apparatus according to claim 8, the vane pump being driven by a controllable motor.

14. The apparatus according to claim 9, the supply line comprising a fourth heating device.

15. The apparatus according to claim 1, the glue reservoir being further connected to said gluing unit via an elastically deformable return line via which express hotmelt can be returned from the glue roller unit to the glue reservoir.

16. The apparatus according to claim 1, a cross-section of the supply line remaining constant during elastic deformation of the supply line when pivoting away the gluing unit into the cleaning position.

* * * * *